US006390645B1

(12) United States Patent
Wu

(10) Patent No.: US 6,390,645 B1
(45) Date of Patent: May 21, 2002

(54) SUPPORT STRUCTURE FOR DECORATIVE LIGHT STRING CIRCUITS

(76) Inventor: Jeng-Shyong Wu, No. 14 Alley 1, Lane 326, Shin-Pin Rd., Hsinchu (TW)

( * ) Notice: Subject to any disclaimer, the term of this patent is extended or adjusted under 35 U.S.C. 154(b) by 0 days.

(21) Appl. No.: 09/574,213

(22) Filed: May 19, 2000

(51) Int. Cl.[7] ..... F21S 13/14

(52) U.S. Cl. ..... 362/252; 362/227; 362/249; 362/391

(58) Field of Search ..... 362/806, 227, 362/249, 252, 391, 159, 161

(56) References Cited

U.S. PATENT DOCUMENTS 2,595,929 A * 5/1952 Dartt ..... 362/252
3,504,169 A * 3/1970 Freeburger ..... 362/249
5,669,707 A * 9/1997 Huang ..... 362/249
5,839,820 A * 11/1998 Huang ..... 362/252
6,116,752 A * 9/2000 Mayfield et al. ..... 362/252
6,126,298 A * 10/2000 Wu ..... 362/252
6,155,697 A * 12/2000 Ahroni ..... 362/252

* cited by examiner

*Primary Examiner*—Sandra O'Shea
*Assistant Examiner*—Ismael Negron
(74) *Attorney, Agent, or Firm*—Troxell Law Office PLLC

(57) ABSTRACT

An assembled device of decorating pendant lamps formed by a string of decorating bulbs combining a multi-layered structure, said string of decorating bulbs being formed by connecting a plurality of bulbs, lamp base or lamp holders, electric conductor wires, a plug or an end connector; the lamp base or lamp holder, and plug or end connector connected to the electric conductor wire have main electric conductor wire and a plurality of branch electric conductor wire which extends from main electric conductor wire. The branch electric conductor wire has multiple bending forming a three-dimensional structure to provide fastening of the decorating lamps, so as to attain a changeful and an effect of decoration.

20 Claims, 14 Drawing Sheets

(B)

(C)

(A)

SUPPORT STRUCTURE FOR DECORATIVE LIGHT STRING CIRCUITS

FIELD OF THE INVENTION

The present invention relates to an assembled device of decorating lamps, and more particularly to a decorating pendant lamp, main electric conductor wire extends to a plurality of branch electric conductor wire, in coordination with multi-layered pendant supporting stand combining a three-dimensional of multi-layered for stabilize the decorating lamps so as to attain an effect of multi-layered three-dimensional decoration.

BACKGROUND OF THE INVENTION

In general festivals, some model animals, such as tiger, horse, leopard, are presented in parade, especially, they are often displayed in night (for example the decorative lantern in the Chinese Lantern Festival), the interior of the models need to be installed with lamps for illumination.

At past, some decorative lamps are installed within the models. A string of bulbs are arranged for emitting light. However, the fixing device of the bulbs is very easy, wherein a supporter is firstly formed, and then bulbs are tied to the bulbs. However, such kind of installation has a bad fastening. Moreover, the installation of bulbs is time-consuming, and easily loosened. Thus, it can be displayed in still state and the effect of displaying is finite.

SUMMARY OF THE INVENTION

Accordingly, the primary object of the present invention is to provide an assembled device of decorating pendant lamps formed by a string of decorating lamp, a main electric conductor wire and branch electric conductor wires. The string of decorating lamps is formed by a plurality of bulbs, lamp base or lamp holder, electric conductor wires, a plug or an end connector. The main electric conductor wire and branch electric conductor wire forming a three-dimensional shape to stabilize the decorating lamps so as to attain an effect of three-dimensional decoration.

Another object of the present invention is to provide an assembled device of decorating pendant lamps, wherein the decorating lamp can stabilize formed in parallel or perpendicular on branch electric conductor wire and obtaining a changeful light.

A further object of the present invention is to provide an assembled device of decorating pendant lamps, wherein the branch electric conductor wire having a plurality of bending forming a three-dimensional structure of curved series connection.

The various objects-and advantages of the present invention will be more readily understood from the following detailed description when read in conjunction with the appended drawing.

DETAILED DESCRIPTION OF THE PREFERRED EMBODIMENTS

Figure 1:
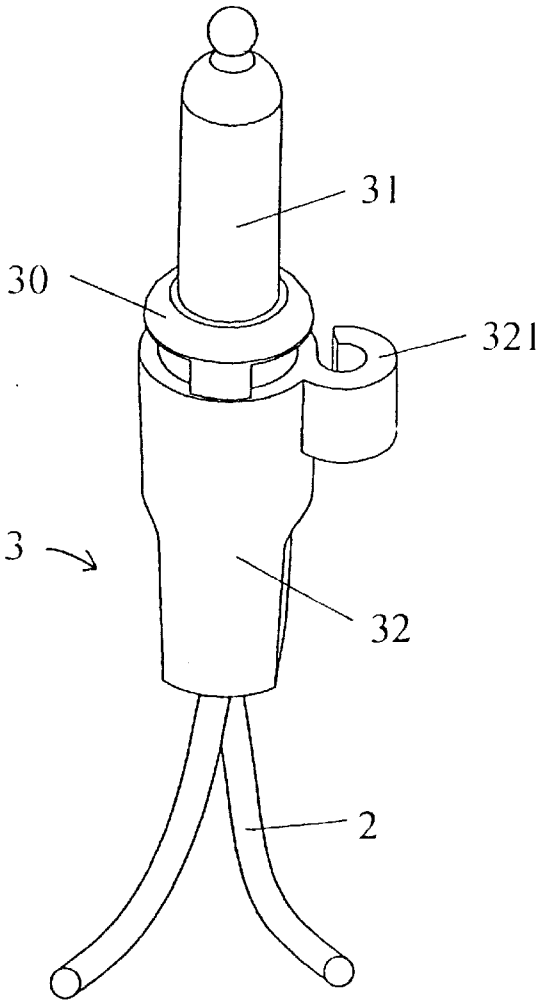
FIG. 1 is an embodiment of the present invention.

As shown in FIG. 1, the decorating lamp according to the present invention includes lamp bodies 3, the upper portion is a bulb 31, the lower portion is a lamp holder 32. The bulb 31 is fastened by lamp base 30, the lamp holder 32 is a cylinder shape, the waist portion of the lateral side of the lamp holder 32 forms a hook 321, and from the lower portion of lamp holder 32 extends the branch electric conductor wire 2.

Figure 2:
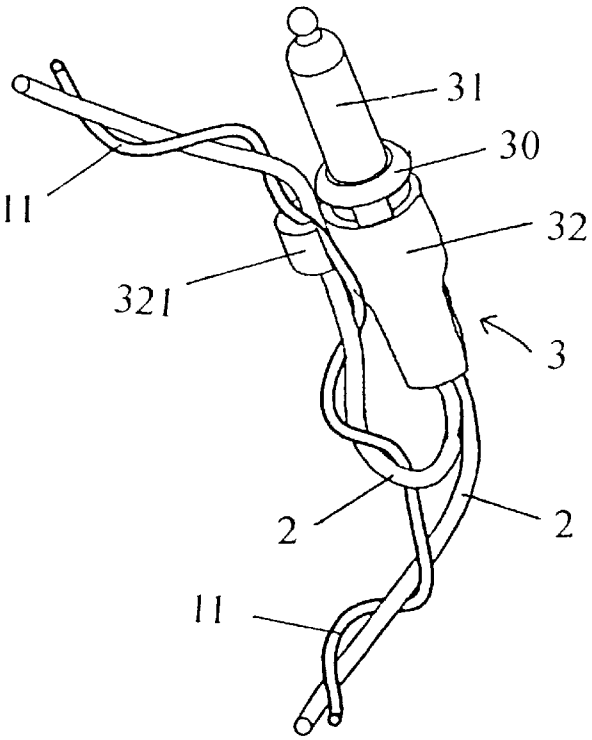
FIG. 2 is a schematic diagram of combination of decorating lamp and electric conductor wire in FIG. 1 according to the present invention.

Referring to FIG. 2, the combination of the lamp bodies 3 and electric conductor wire is being support by winding the non-electrical connector 11 around the branch electric conductor wire 2. As to enhance the fastening of the lamp holder, the waist portion of the lateral side of the lamp holder 32 is formed with a hook 321 for installing the branch electric conductor wire 2 and non-electrical wire 11 to the hook 321 for being fixed.

Figure 3:
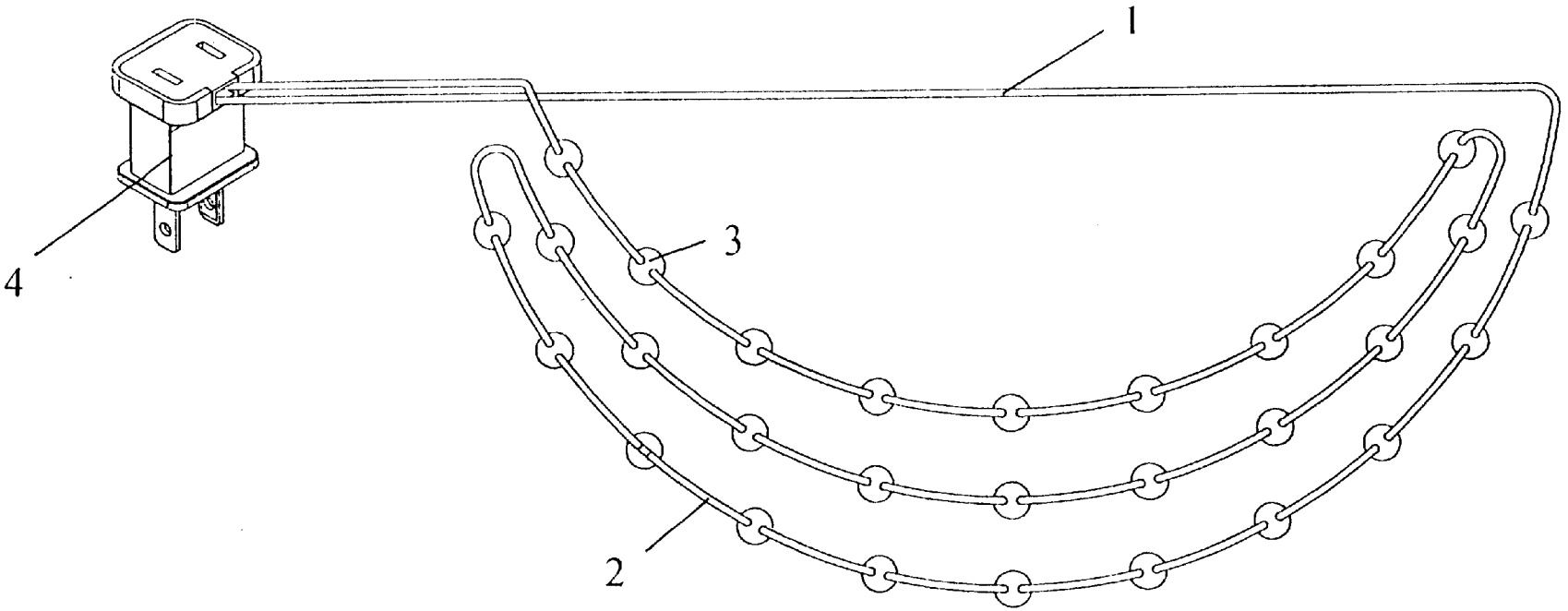
FIG. 3 is a schematic diagram showing the first embodiment of circuit according to the present invention.

FIG. 3 shows the combination of the single pendant structure according to the present invention. The branch electric conductor wire 2 extends from the main electric conductor wire 1 curved back and forth for several times forming a half-spherical pendant shape. The decorating lamp bodies 3 fastened interval on the branch electric conductor wire 2, the lamp bodies 3 of the present embodiment is fastened vertically to the branch electric conductor wire 2. And the main electric conductor wire 1 connected to plug 4 for conduction.

Figure 4:
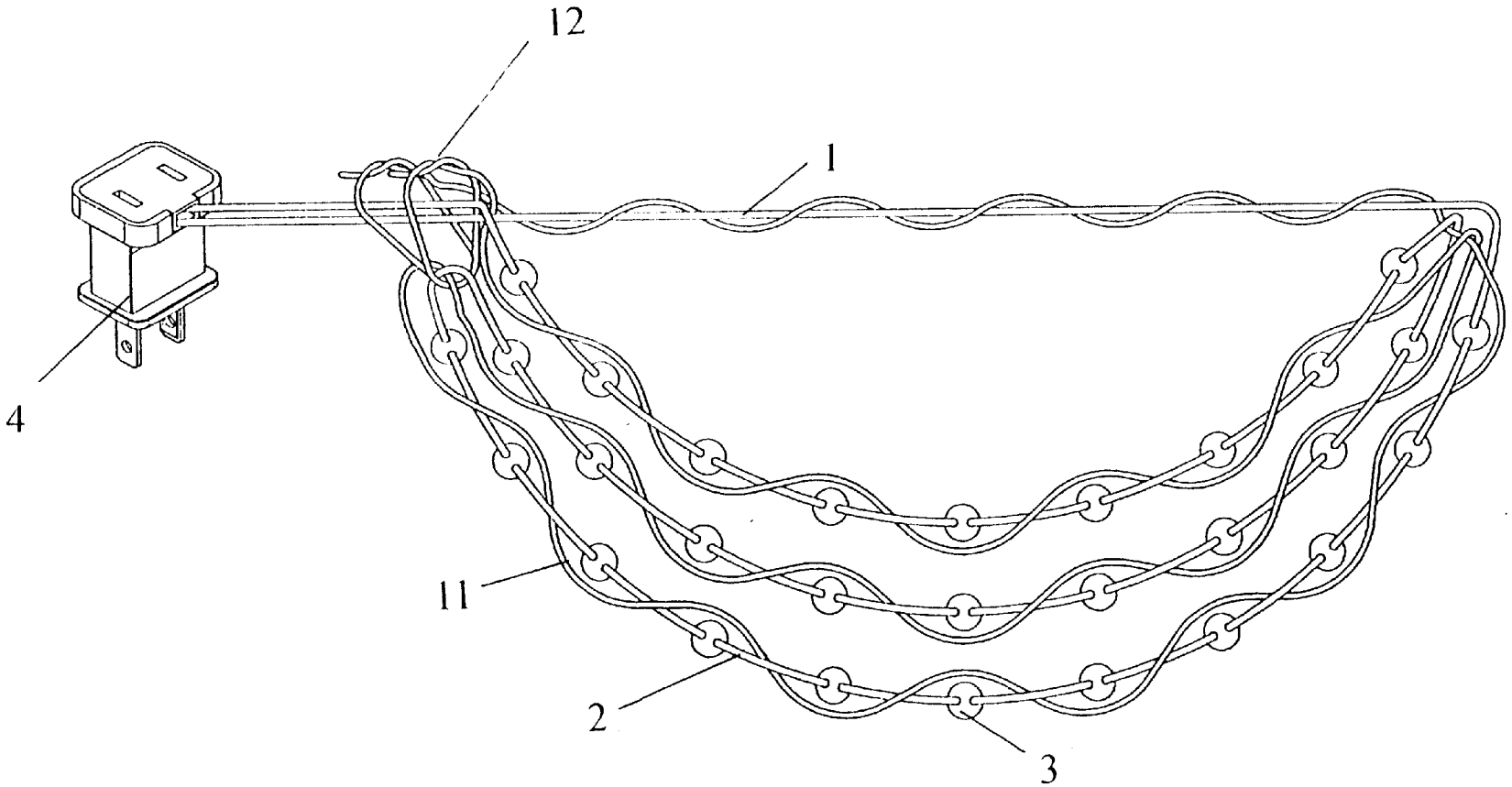
FIG. 4 is a schematic diagram showing an embodiment of circuit in FIG. 3 according to the present invention.

FIG. 4 is a schematic diagram showing an embodiment of circuit in FIG. 3 according to the present invention, the combination is a single pendant device which is same as the combination of the first embodiment. The main difference is added a non-electrical connector 11, which uses winding method to support the circuit, on the branch electric conductor wire 2. The non-electrical connector 11 firstly winds around the main electric conductor wire 1, then the branch electric conductor wire 2. Tying the main electric conductor wire 1 and the two ends of non-electrical connector 11 together with knot 12 supports the non-electrical connector 11.

Figure 5:
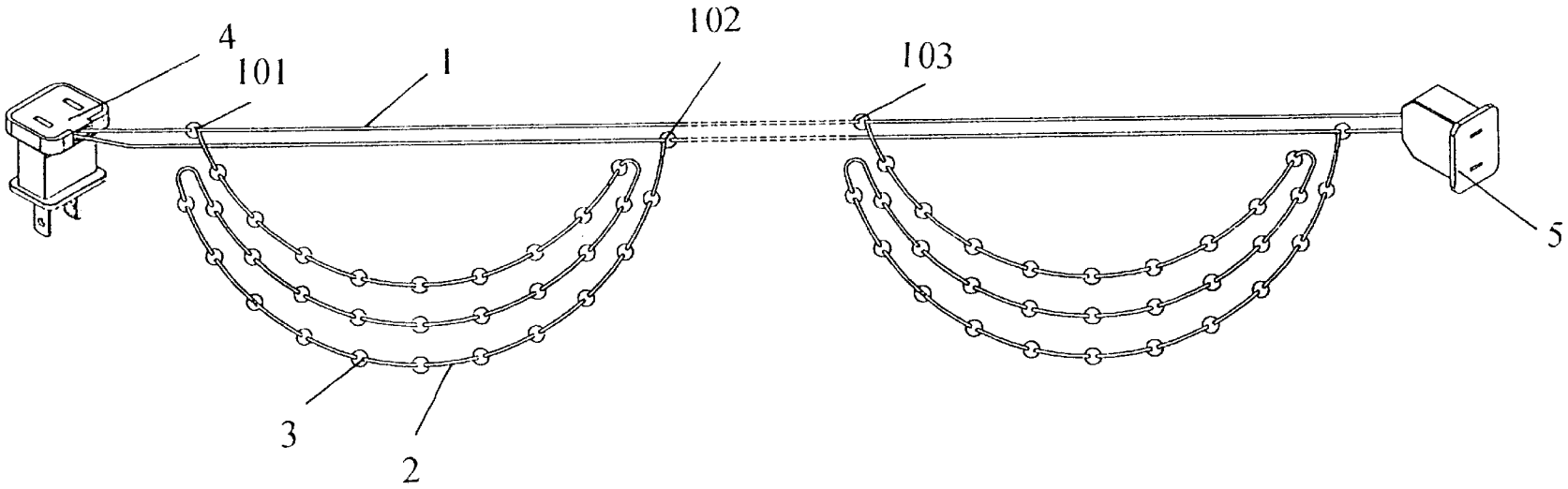
FIG. 5 is a schematic diagram showing the second embodiment of circuit according to the present invention.

FIG. 5 is a schematic diagram showing the second embodiment of circuit in FIG. 4 according to the present invention in which has a double pendant structure. The branch electric conductor wire 2 extends from the main electric conductor wire 1 bending back and forth repeatedly in two groups forming two half-spherical pendant structure, and the lamp bodies 3 of decorating lamps fastened interval on branch electric conductor wire 2. Moreover, the two ends of main electric conductor wire 1 are a plug 4 and an end connector 5 respectively. The main conductor wire 1 may further connects bulbs 101,102, . . .

Figure 6:
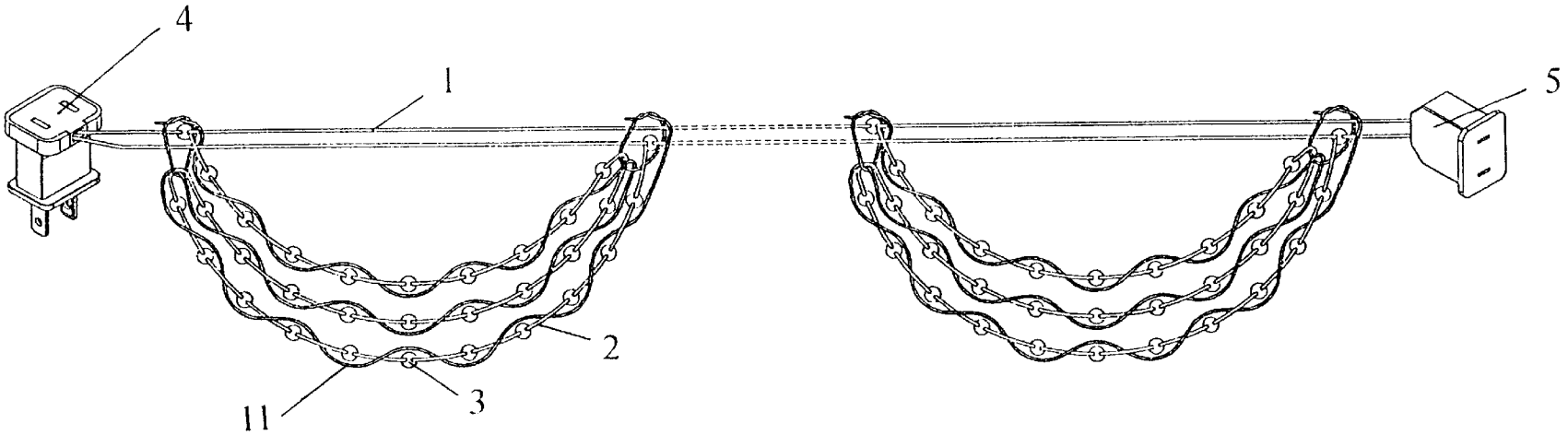
FIG. 6 is a schematic diagram showing an embodiment of circuit in FIG. 5 according to the present invention.

Referring to FIG. 6, a circuit of the present invention in FIG. 5. In application, using a bendable non-electrical connector 11 winding the said two groups of half-spherical pendant lamps, and hook or tie a knot on the main electric conductor wire 1 forming the entire string of lamps.

Figure 7:
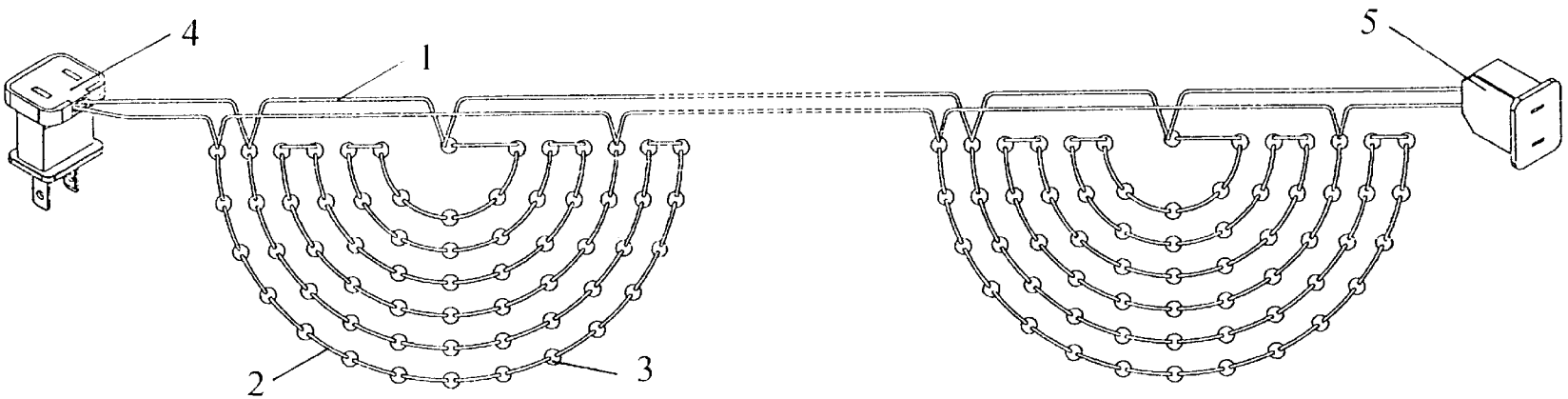
FIG. 7 is a schematic diagram showing the third embodiment of circuit according to the present invention.
Figure 8:
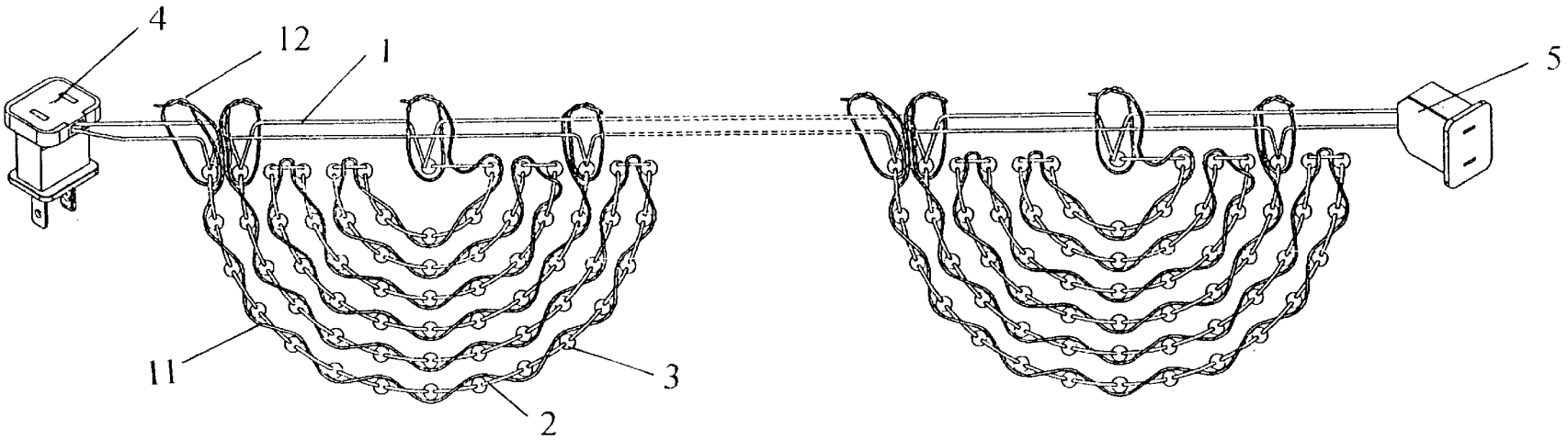
FIG. 8 is a schematic diagram showing an embodiment of circuit in FIG. 7 according to the present invention.

Referring again to FIG. 7, the application circuit of double pendant structure of the present invention can be formed by not installing bulbs on the main electric conductor wire 1. The support structure of circuit is shown in FIG. 8, using a bendable non-electrical connector 11 winding the branch electric conductor wire 2 of the two groups of half-spherical pendant lamp. The main electric conductor wire 1 may also install a plurality of knot 12, and fastened the end portion of non-electrical connector 11 on the knot 12.

Figure 9:
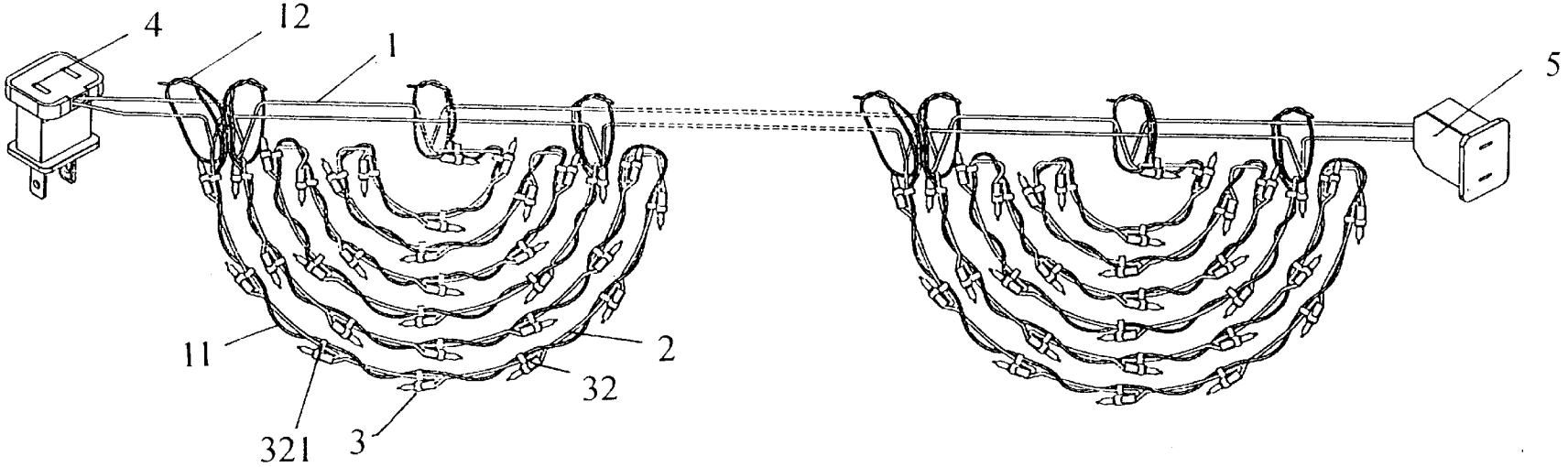
FIG. 9 is a schematic diagram showing another embodiment of circuit in FIG. 7 according to the present invention.

FIG. 9 shows the application that the embodiment shown in FIG. 8 after installing bulbs, wherein the lamp holder 32 has a hook 321 as shown in FIG. 1.

Figure 10:
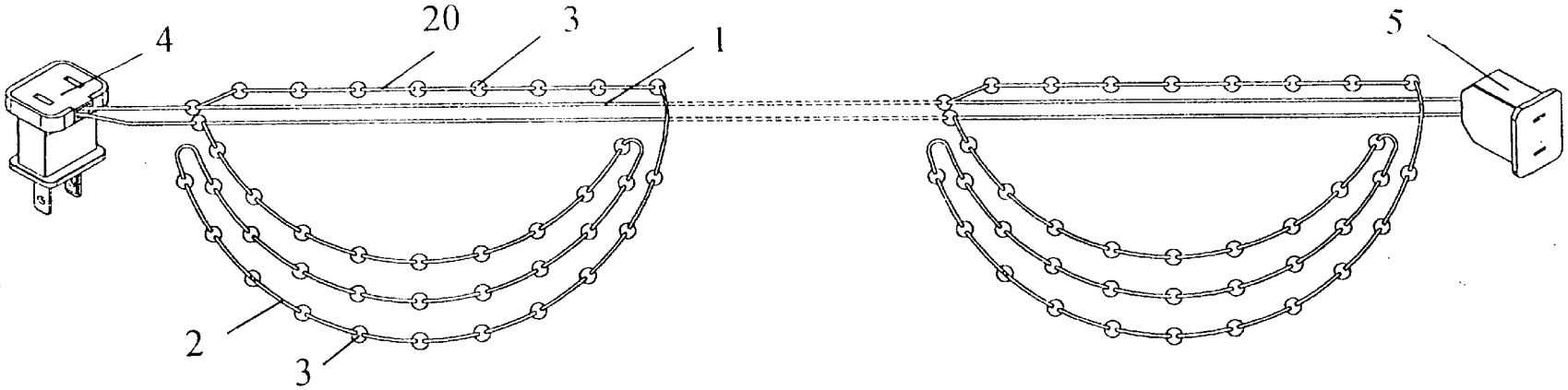
FIG. 10 is a schematic diagram showing the forth embodiment of circuit according to the present invention.
Figure 11:
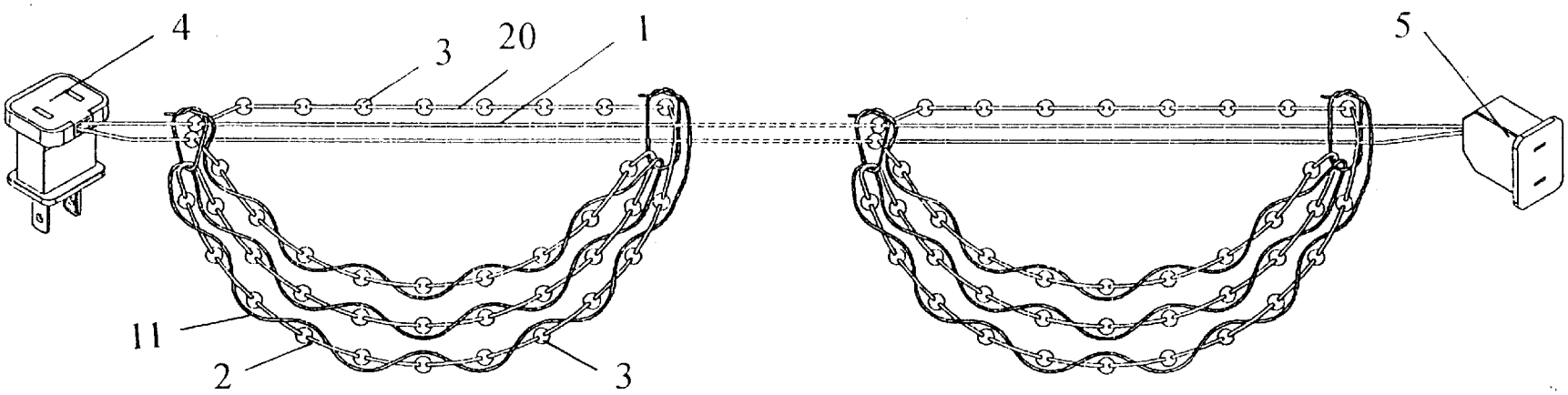
FIG. 11 is a schematic diagram showing an embodiment of circuit in FIG. 10 according to the present invention.

The circuit of the present invention is shown in FIG. 10, besides having lamp bodies 3 on the main electric conductor wire 1, also having a branch electric conductor wire 20 parallel with the main electric conductor wire 1 to lighten the lateral side of the main electric conductor wire 1. Using the non-electrical connector 11 supporting the string of lamps is shown in FIG. 11.

Figure 12:
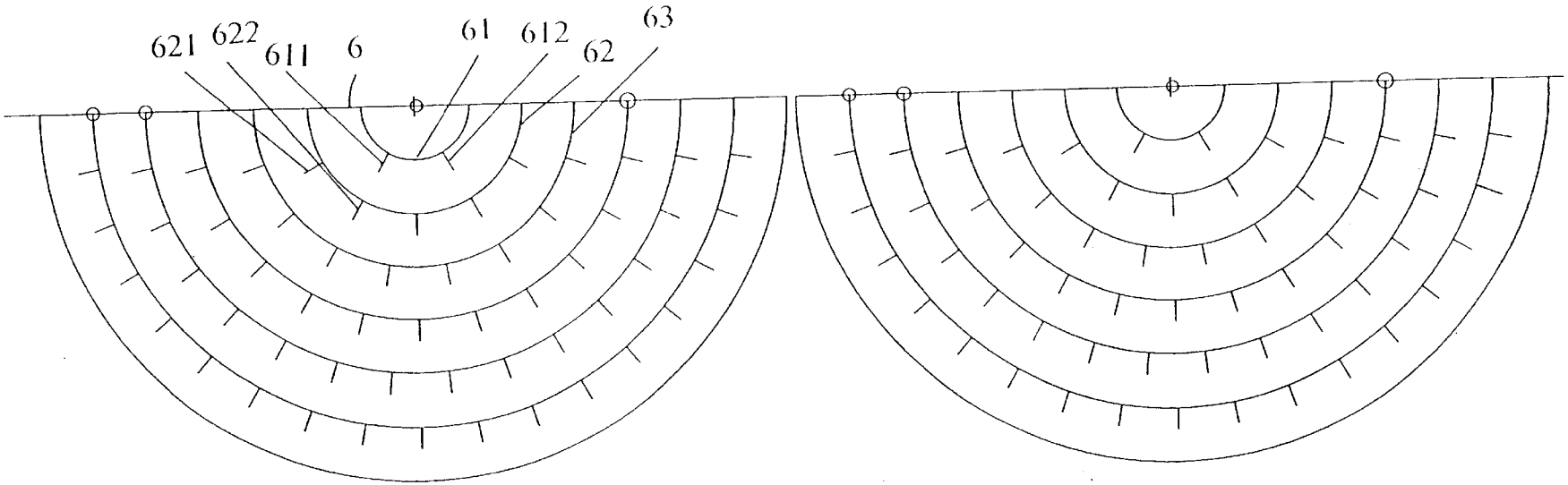
FIG. 12 is a schematic diagram showing an embodiment of the supporting stand of decorating lamps according to the present invention.
Figure 13:
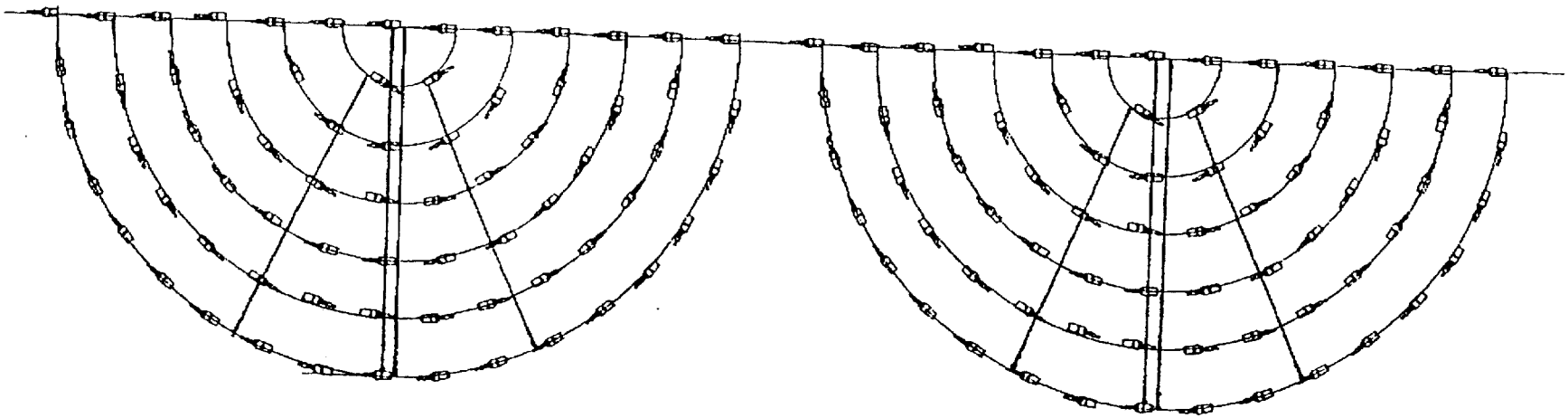
FIG. 13 is an implement state diagram showing the support stand of decorating lamp according to the present invention.

The said constitutions of fastening the string of lamps by branch electric conductor wire are shown in FIG. 12 and FIG. 13. Using metal strips bending into supporting stand 6 for supporting, the supporting rack 6 is formed from a plurality of concentric ring 61,61, . . . and unciform hook 611,612, . . . , 621,622, . . . which sticking out from the concentric ring 61,62, . . . The installation of the string of lamp is shown in FIG. 13.

Figure 14:
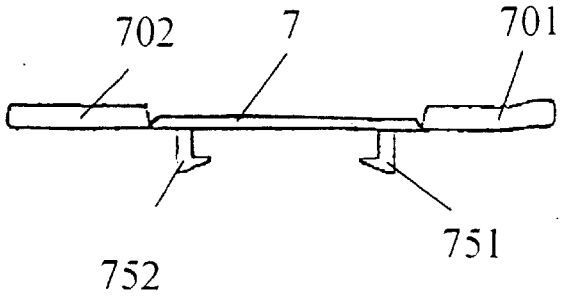
FIG. 14 is three view diagrams of fixed slice according to the present invention.
Figure 14:
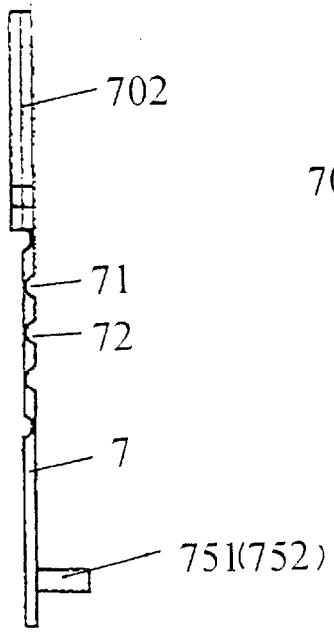
Figure 14:
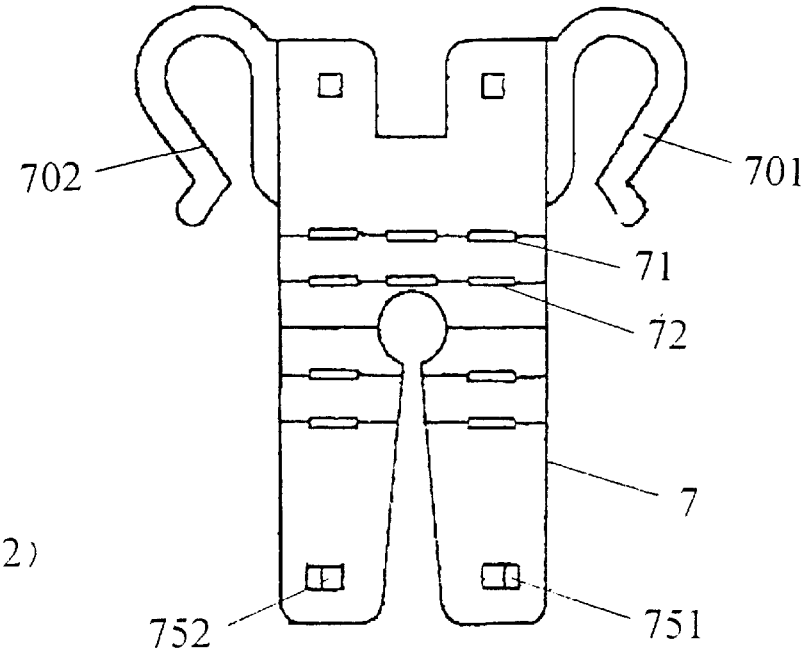
Figure 15:
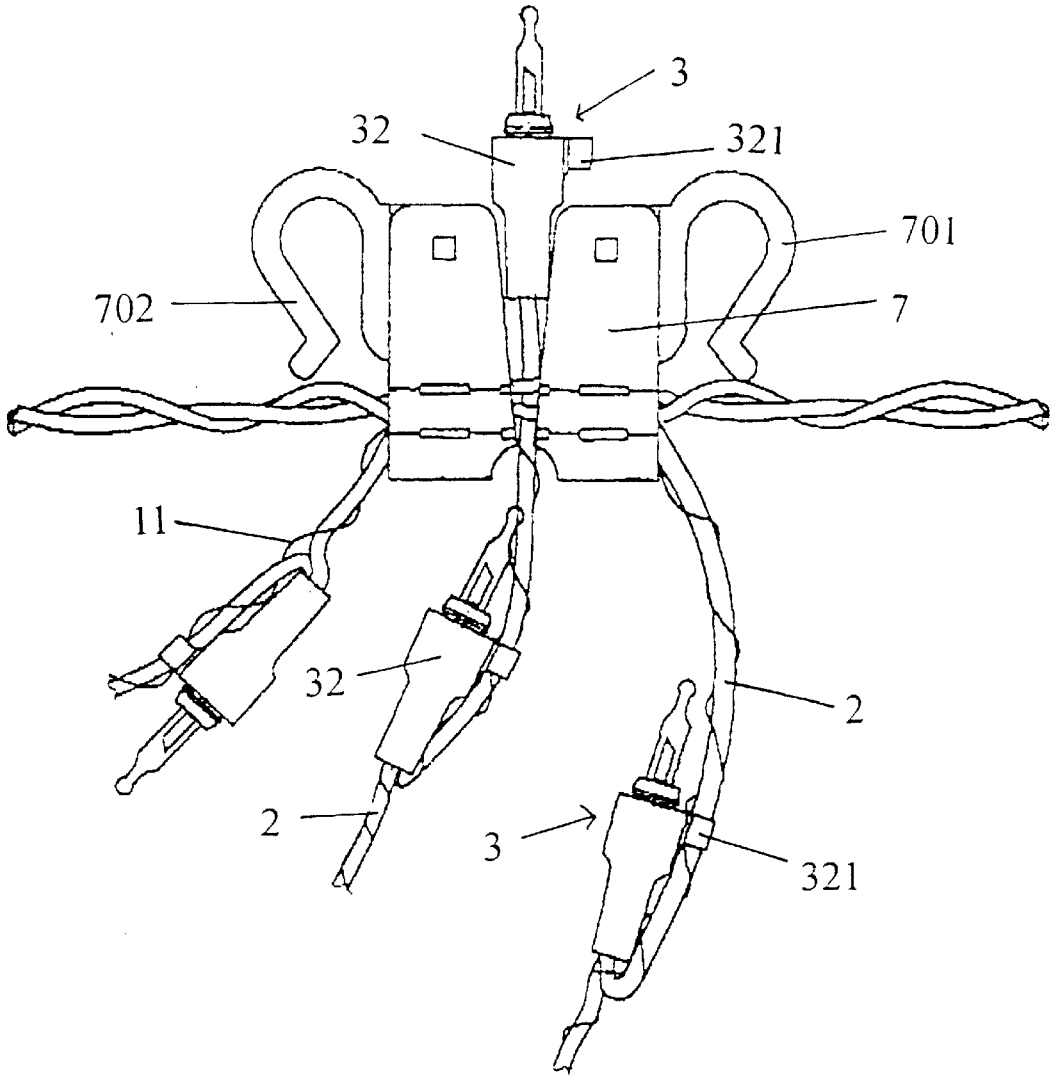
FIG. 15 is an implement diagram showing the fixed slice according to the present invention.

The said non-electrical connector 11 can be fastened by a fixed slice 7 which shown in FIG. 14. The fixed slice 7 is in laminated structure, the middle laminated main body forming a plurality of lateral fillister 71,72, . . . , and fixed unciform hook 751,752, . . . , and two sides having fixed hook 701,702, . . . , resulted in the lamp bodies and electric conductor wire of string of lamp can be supported stability, such fixed slice is shown in FIG. 15.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An assembled device of decorating pendant lamps formed by a string of decorating bulbs combining a multi-layered structure, said string of decorating bulbs being formed by connecting a plurality of bulbs, lamp base or lamp holders, electric conductor wires, a plug or an end connector, the lamp base or lamp holder, and plug or end connector connected to an electric conductor wire having a main electric conductor wire and a plurality of branch electric conductor wires which extend from main electric conductor wire, each branch electric conductor wire having multiple bends forming a three-dimensional structure to provide fastening of the decorating lamps.

2. The assembled device of decorating pendant lamps as claimed in claim 1, wherein the main electric conductor wire extends to a branch electric conductor wire bending repeatedly back and forth in a group or a plurality groups forming one or a plurality of half-spherical pendant decorating lamps.

3. The assembled device of decorating pendant lamps as claimed in claim 2, wherein the decorating lamps used a fixing device fastened on a support stand.

4. The assembled device of decorating pendant lamps as claimed in claim 2, wherein the non-electrical connector winding around the branch electric conductor wire as to maintain its shape.

5. The assembled device of decorating pendant lamps as claimed in claim 1, wherein the decorating lamps used a fixing device fastened on a support stand.

6. The assembled device of decorating pendant lamps as claimed in claim 5, wherein the non-electrical connector is fastened on the main electric conductor wire by tying a knot.

7. The assembled device of decorating pendant lamps as claimed in claim 5, wherein the branch electric conductor wire extends from the main electric conductor wire has a plurality of lamp bodies.

8. The assembled device of decorating pendant lamps as claimed in claim 7, wherein the waist portion of the lateral side of the lamp holder is formed with a hook for installing the branch electric conductor wire and non-electrical wire to the hook for being fixed.

9. The assembled device of decorating pendant lamps as claimed in claim 7, wherein one end of the main electric conductor wire connected to the plug and the other end connected to end connector.

10. The assembled device of decorating pendant lamps as claimed in claim 7, wherein the main electric conductor wire has structure of with lamp bodies or without lamp bodies.

11. The assembled device of decorating pendant lamps as claimed in claim 7, wherein the non-electrical connector is fastened using a fixed slice, the fixed slice is in laminated structure, the middle laminated main body forming a plurality of lateral fillister and fixed unciform hook, and two sides having fixed hook.

12. The assembled device of decorating pendant lamps as claimed in claim 7, wherein the main electric conductor wire may also install lamp bodies.

13. The assembled device of decorating pendant lamps as claimed in claim 12, wherein the connection of the main electric conductor wire and the branch electric conductor wire may be single group or plural group.

14. The assembled device of decorating pendant lamps as claimed in claim 1, wherein the non-electrical connector winding around the branch electric conductor wire as to maintain its shape.

15. The assembled device of decorating pendant lamps as claimed in claim 14, wherein the branch electric conductor wire extends from the main electric conductor wire has a plurality of lamp bodies.

16. The assembled device of decorating pendant lamps as claimed in claim 14, wherein the non-electrical connector is fastened on the main electric conductor wire by tying a knot.

17. The assembled device of decorating pendant lamps as claimed in claim 14, wherein the branch electric conductor wire is fastened on supporting stand of fixed shape.

18. The assembled device of decorating pendant lamps as claimed in claim 17, wherein the supporting stand for supporting the branch electric conductor wire is formed from a plurality of concentric ring and unciform hook which sticking out from the concentric ring, and can hook the unciform hook of the branch electric conductor wire.

19. The assembled device of decorating pendant lamps as claimed in claim 17, wherein the branch electric conductor wire extends from the main electric conductor wire has a plurality of lamp bodies.

20. The assembled device of decorating pendant lamps as claimed in claim 17, wherein the non-electrical connector is fastened on the main electric conductor wire by tying a knot.

* * * * *